US007036334B2

(12) United States Patent
Ko et al.

(10) Patent No.: US 7,036,334 B2
(45) Date of Patent: May 2, 2006

(54) REFRIGERATOR HAVING TEMPERATURE CONTROLLED CHAMBER

(75) Inventors: Sung Bok Ko, Pusan (KR); Myung Wouk Kim, Kwangju (KR); Hak Gyun Bae, Kyungsangbuk-Do (KR); Yoon Young Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 241 days.

(21) Appl. No.: 10/677,334

(22) Filed: Oct. 3, 2003

(65) Prior Publication Data

US 2005/0016202 A1 Jan. 27, 2005

(30) Foreign Application Priority Data

Jan. 27, 2003 (KR) ..... 10-2003-0005322

(51) Int. Cl.
*F25D 21/00* (2006.01)
*F25D 17/04* (2006.01)
*F25D 11/02* (2006.01)

(52) U.S. Cl. ..... 62/441; 62/408; 62/272

(58) Field of Classification Search ..... 62/441, 62/408, 186, 89

See application file for complete search history.

(56) References Cited

U.S. PATENT DOCUMENTS 4,689,966 A * 9/1987 Nonaka ..... 62/187
4,732,009 A * 3/1988 Frohbieter ..... 62/89
4,732,014 A * 3/1988 Frohbieter ..... 62/382
5,899,083 A * 5/1999 Peterson et al. ..... 62/186
6,802,369 B1 * 10/2004 Zentner et al. ..... 165/267

* cited by examiner

*Primary Examiner*—Chen Wen Jiang
(74) *Attorney, Agent, or Firm*—Staas & Halsey LLP

(57) ABSTRACT

A refrigerator having a temperature-controlled chamber, which stores food to be readily cooked without a thawing process. A cool air inlet port introduces cool air from the freezer compartment into the temperature-controlled chamber. The cool air inlet port is opened or closed by an intake damper. A cooling fan and a temperature sensor are installed in the temperature-controlled chamber. A cool air discharging duct is provided to guide the cool air from the temperature-controlled chamber into the freezer compartment. An inlet of the cool air discharging duct is connected to a portion of the temperature-controlled chamber. A heater is mounted to an outer surface of the outlet of the cool air discharging duct to perform a defrosting operation.

21 Claims, 6 Drawing Sheets

REFRIGERATOR HAVING TEMPERATURE CONTROLLED CHAMBER

CROSS-REFERENCE TO RELATED APPLICATION

This application claims the benefit of Korean Application No. 2003-5322, filed Jan. 27, 2003, in the Korean Intellectual Property Office, the disclosure of which is incorporated herein by reference.

BACKGROUND OF THE INVENTION

1. Field of the Invention

The present invention relates, in general, to refrigerators and, more particularly, to a refrigerator which is provided with a refrigerator compartment thereof with a temperature-controlled chamber which is maintained at a predetermined temperature using cool air of a freezer compartment, thus allowing items to be stored at a predetermined temperature between a temperature of the refrigerator compartment and a temperature of the freezer compartment; and a method to cool such a refrigerator.

2. Description of the Related Art

As is well known to those skilled in the art, a refrigerator is an appliance which stores various kinds of food items for a lengthy period of time, by supplying cool air from an evaporator to a freezer compartment and a refrigerator compartment so as to maintain the freshness of the food items for a lengthy period of time. The freezer compartment is used for storing food items which must be maintained at a temperature below their freezing temperature, such as meat, fish and ice cream. On the other hand, the refrigerator compartment is used for storing food items which must be maintained at a low temperature, but at a temperature above their freezing temperature, such as vegetables, fruits, and various kinds of beverages.

Recently, a preference for a large-capacity refrigerator has increased, because a large quantity of foods are stored in the large-capacity refrigerator, thus providing convenience to a consumer. The large-capacity refrigerator has a side-by-side structure, which is provided on one side with a freezer compartment and on its other side with a refrigerator compartment. The refrigerator compartment and the freezer compartment are provided with a plurality of shelves and drawers so as to easily store a large quantity of foods in the refrigerator.

Thus, the refrigerator compartment stores vegetables or fruits at a low temperature above their freezing temperature to keep the vegetables or fruits fresh without freezing them. Meanwhile, the freezer compartment freezes and stores perishable meat or fish, thus allowing the meat or fish to be preserved for a lengthy period of time.

When one desires to cook meat or fish stored in the freezer compartment, the meat or fish must be thawed for a lengthy period of time because the meat or fish stored in the freezer compartment are frozen.

Thus, in the case of meat or fish that have been stored for a while, the meat or fish should not be completely frozen so as to be easily and rapidly cooked. The conventional refrigerator has only the refrigerator compartment, which is maintained at a temperature above the freezing temperature, in addition to the freezer compartment. The refrigerator compartment, however, is not cold enough to be suitable for a long storing of meat or fish.

Further, the conventional refrigerator has a problem in that the refrigerator compartment is frequently opened or closed. Thus, an interior of the refrigerator compartment is not maintained at a proper temperature as a temperature variation thereof is undesirably great, thus not maintaining the freshness of meat or fish stored therein.

SUMMARY OF THE INVENTION

Accordingly, it is an aspect of the present invention to provide a refrigerator having a temperature-controlled chamber, which maintains the freshness of food, such as meat or fish, and stores the food in such a way that the food is immediately cooked without the necessity of thawing the food.

The foregoing and/or other aspects of the present invention are achieved by providing a refrigerator, including a refrigerator compartment and a freezer compartment, a temperature-controlled chamber, a cool air inlet port, and a cool air discharging duct. The refrigerator compartment and the freezer compartment are partitioned from each other by a vertical partition wall. The temperature-controlled chamber is provided in the refrigerator compartment in such a way as to be partitioned from the refrigerator compartment. A cool air inlet port is in the vertical partition wall to introduce cool air from the freezer compartment into the temperature-controlled chamber. A cool air discharging duct is provided along walls of the refrigerator and freezer compartments to discharge the cool air from the temperature-controlled chamber into the freezer compartment.

An inlet of the cool air discharging duct is connected to a cool air discharging passage provided at the temperature-controlled chamber to guide the cool air from the temperature-controlled chamber through the inlet of the cool air discharging duct to the cool air discharging duct. An outlet of the cool air discharging duct is arranged at a position adjacent to an inlet of a freezer compartment evaporator to introduce the cool air from the cool air discharging duct into the freezer compartment evaporator which is mounted in the freezer compartment.

According to one aspect of the present invention, the outlet of the cool air discharging duct is downwardly inclined toward the inlet of the freezer compartment evaporator. A heater is mounted to the outlet of the cool air discharging duct to perform a defrosting operation.

An intake damper is installed in the cool air inlet port at a side around the temperature-controlled chamber so as to open or close the cool air inlet port.

Further, a cooling fan is mounted at a rear portion of the temperature-controlled chamber in such a way as to be positioned adjacent to the cool air inlet port, thus forcibly circulating the cool air from the freezer compartment through the temperature-controlled chamber and the cool air discharging duct to the freezer compartment evaporator.

The intake damper comprises a thin plate, thus opening the air inlet port in response to the cool air flowing into the temperature-controlled chamber when the cooling fan is operated, and closing the cool air inlet port in response to a stoppage of flow of the cool air when the cooling fan is stopped.

Further, a temperature sensor is mounted in the temperature-controlled chamber to control an operation of the cooling fan, thus allowing an interior of the temperature-controlled chamber to be maintained at a preset temperature.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
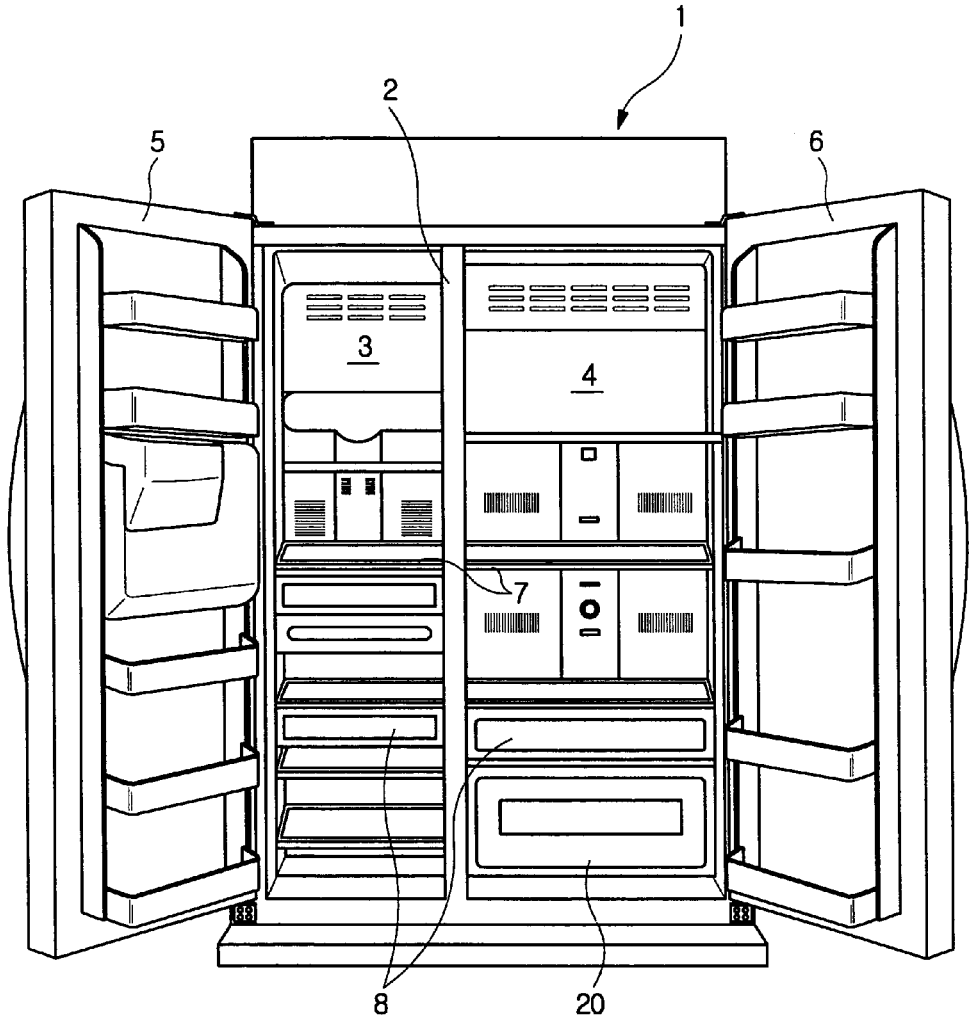
FIG. 1 is a view of a refrigerator, according to an embodiment of the present invention.

Reference will now be made in detail to the present preferred embodiments of the an embodiment of present invention, examples of which are illustrated in the accompanying drawings, wherein like reference numerals refer to like elements throughout.

Figure 2:
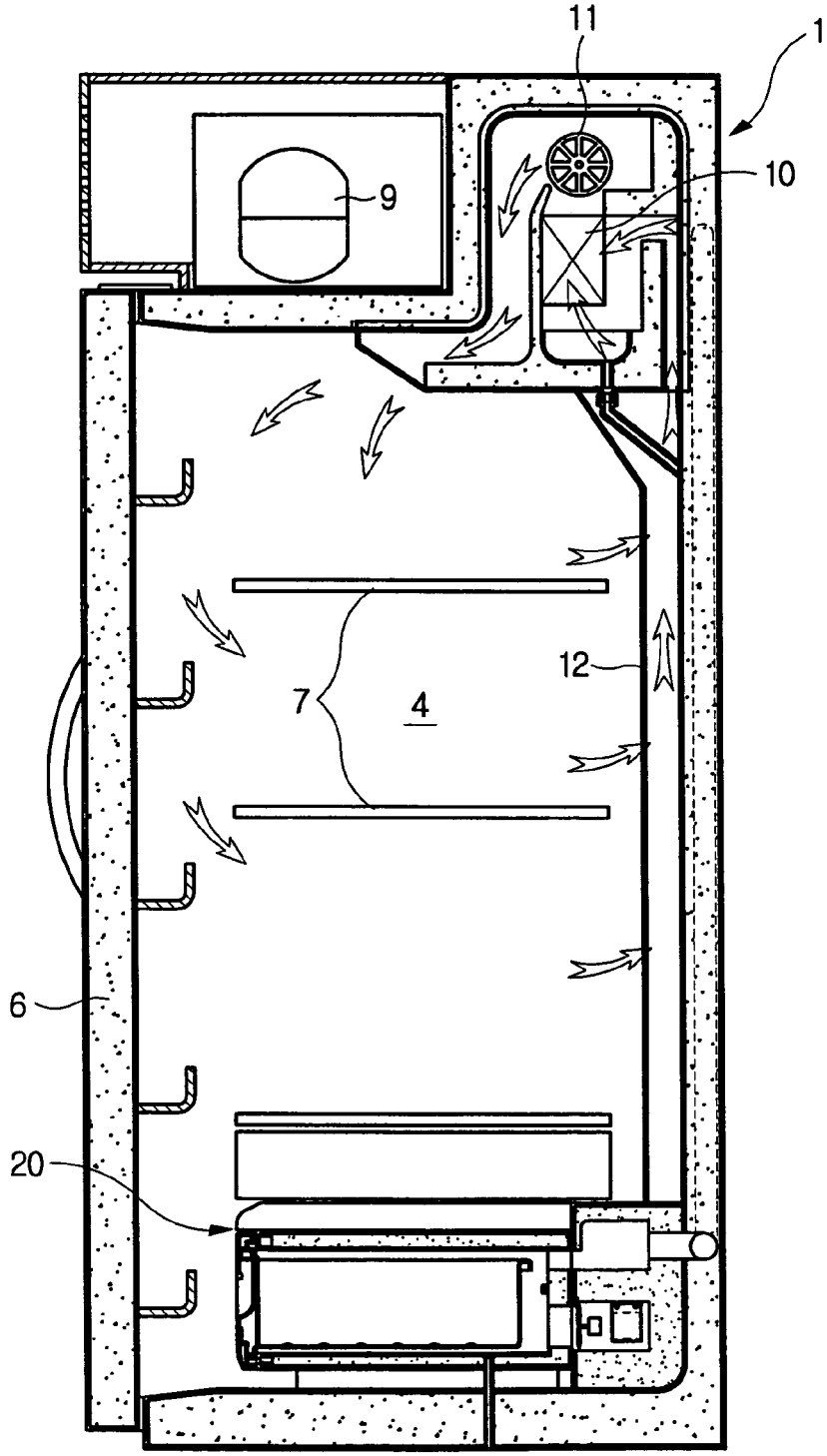
FIG. 2 is a sectional view of the refrigerator illustrated in FIG. 1.

FIG. 1 is a perspective view of a refrigerator, according to an embodiment of the present invention. FIG. 2 is a sectional view of the refrigerator illustrated in FIG. 1.

As illustrated in FIG. 1, a refrigerator according to an embodiment of the present invention includes a cabinet 1 which defines an external appearance of the refrigerator and defines a space for storing food items. A vertical partition wall 2 is arranged in the cabinet 1. A freezer compartment 3 and a refrigerator compartment 4 are partitioned from each other by the vertical partition wall 2 so that the freezer compartment 3 is provided on one side of the refrigerator and the refrigerator compartment 4 is provided on another side of the refrigerator. A freezer door 5 is hinged to a front of the freezer compartment 3 to open or close the freezer compartment 3, and a storage door 6 is hinged to a front of the refrigerator compartment 4 to open or close the refrigerator compartment 4.

The freezer compartment 3 is maintained at an example temperature between −16° C. and −21° C. so as to keep foods, such as meat, fish, and ice cream frozen. On the other hand, the refrigerator compartment 4 is maintained at an example temperature between 3° C. and 5° C., thus keeping foods, such as vegetables, fruits, and beverages, fresh. The freezer compartment 3 and the refrigerator compartment 4 are provided with a plurality of shelves 7 and drawers 8 to effectively store food therein.

Further, the refrigerator according to an embodiment of the present invention is provided with a temperature-controlled chamber 20. The temperature-controlled chamber 20 functions to store food at a predetermined temperature between a temperature of the freezer compartment 3 and a temperature of the refrigerator compartment 4.

As illustrated in FIG. 2, a compressor 9, a refrigerator compartment evaporator 10 and a refrigerator compartment blowing fan 11, which together function to cool an interior of the refrigerator compartment 4, are mounted at a portion, e.g., an upper portion of the refrigerator compartment 4. A guide duct 12 is provided in a portion, e.g., a rear portion of the refrigerator compartment 4, so that air is guided to the refrigerator compartment evaporator 10 after being circulated in the refrigerator compartment 4.

According to an embodiment of the present invention, a temperature-controlled chamber 20 is provided in a portion, e.g., a lower portion of the refrigerator compartment 4 in such a way as to be partitioned from the refrigerator compartment 4. Thus, the temperature-controlled chamber 20 is mainly cooled by cool air fed from the freezing compartment 3, rather than by cool air circulating in the refrigerator compartment 4, thus being maintained at a predetermined temperature between a temperature of the freezer compartment 3 and a temperature of the refrigerator compartment 4.

Figure 3:
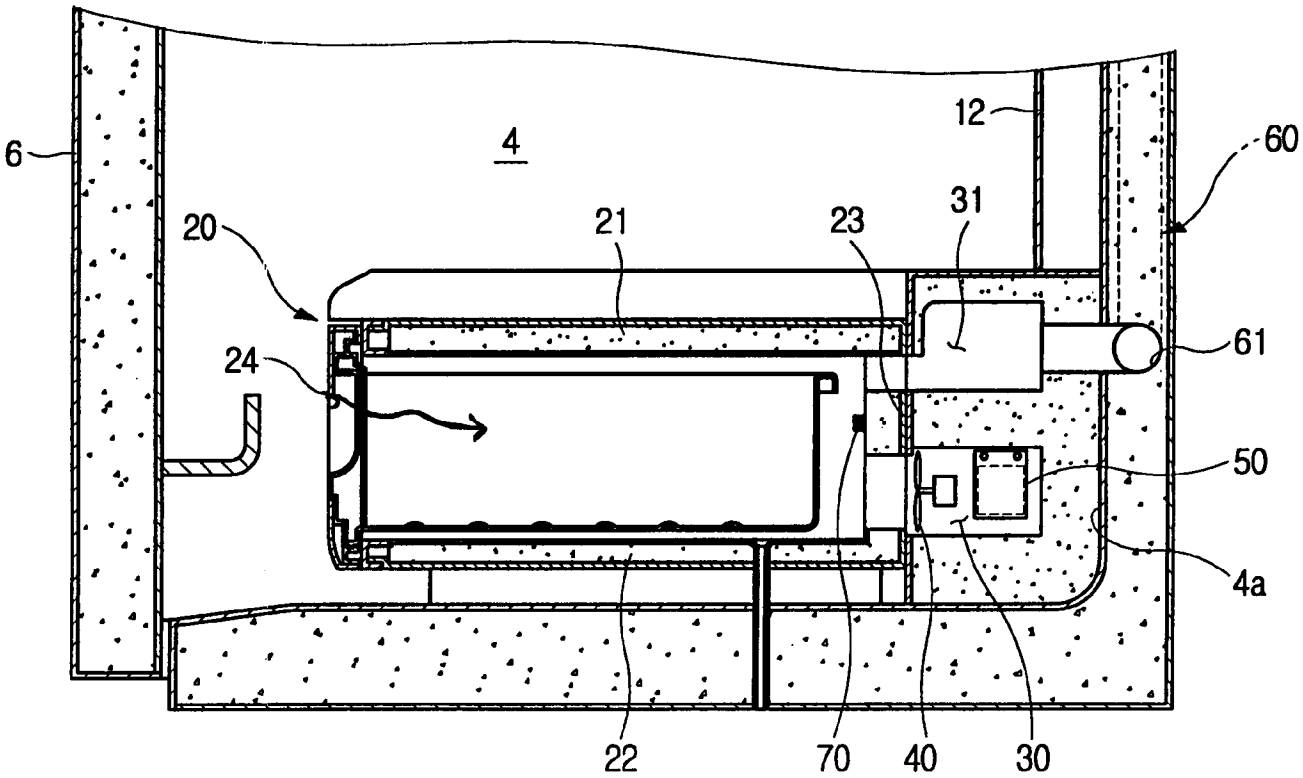
FIG. 3 is a sectional view of a temperature-controlled chamber installed in a refrigerator compartment of the refrigerator, according to an embodiment of the present invention, with an intake damper being closed.
Figure 4:
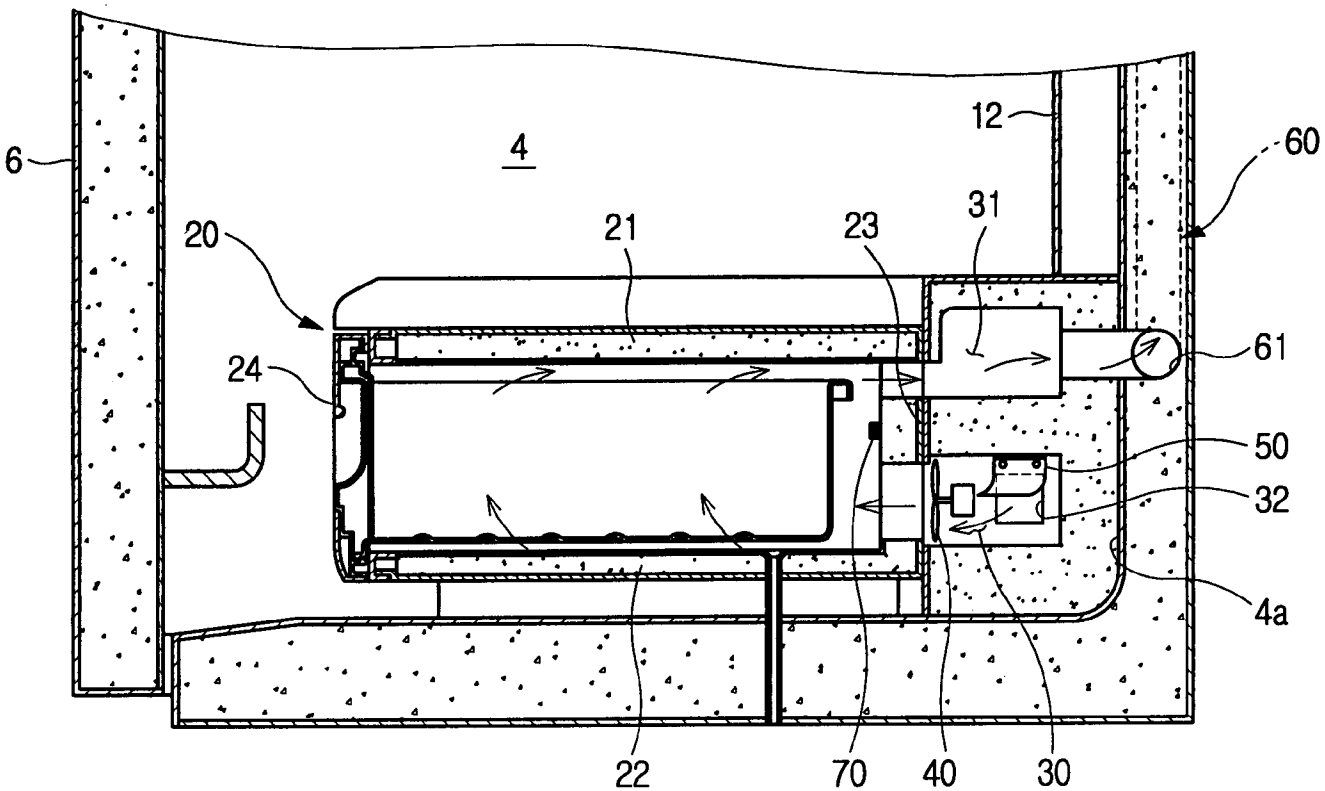
FIG. 4 is a sectional view of the temperature-controlled chamber installed in the refrigerator compartment of the refrigerator, according to an embodiment of the present invention, with the intake damper being opened.

FIG. 3 is a sectional view of a temperature-controlled chamber installed in a refrigerator compartment of the refrigerator, according to an embodiment of the present invention, with an intake damper being closed. FIG. 4 is a sectional view of the temperature-controlled chamber installed in the refrigerator compartment of the refrigerator, according to the an embodiment of the present invention, with the intake damper being opened.

As illustrated in the drawings, the temperature-controlled chamber 20 includes an upper insulation wall 21, a lower insulation wall 22, side insulation walls (not shown), and a rear insulation wall 23, and has a box shape which is opened at a front thereof. The terms such as upper, lower, side, and box are, as is well understood in the art, to aid illustration only and not intended to restrict placement. A drawer 24 for storing food items therein is put into the temperature-controlled chamber 20 to be moved forward and backward. A cool air intake passage 30 and a cool air discharging passage 31 are provided between the rear insulation wall 23 of the temperature-controlled chamber 20 and a rear wall **4*a* of the refrigerator compartment 4 so as to circulate cool air from the freezer compartment 3 to the temperature-controlled chamber 20**.

The temperature-controlled chamber 20 which is partitioned from the refrigerator compartment 4 in the refrigerator compartment 4 is cooled by cool air fed from the freezer compartment 3. The circulation of the cool air which is fed from the freezer compartment 3 into the temperature-controlled chamber 20 provided in the refrigerator compartment 4 will be described later with reference to FIGS. 5 and 6.

A cooling fan 40 is installed in the cool air intake passage 30 so as to forcibly circulate the cool air from the freezer compartment 3 to the temperature-controlled chamber 20, which is provided in the refrigerator compartment 4, and forcibly circulate the cool air from the temperature-controlled chamber 20 to the freezer compartment 3. Further, an intake damper 50 is installed in the cool air intake passage 30 to control flow of the cool air, thus selectively allowing the cool air to flow into the temperature-controlled chamber 20 and preventing the cool air from flowing into the temperature-controlled chamber 20.

Further, a temperature sensor 70 is mounted in the temperature-controlled chamber 20 to control an operation of the cooling fan 40, thus allowing an interior of the temperature-controlled chamber 20 to be maintained at a preset temperature.

Figure 5:
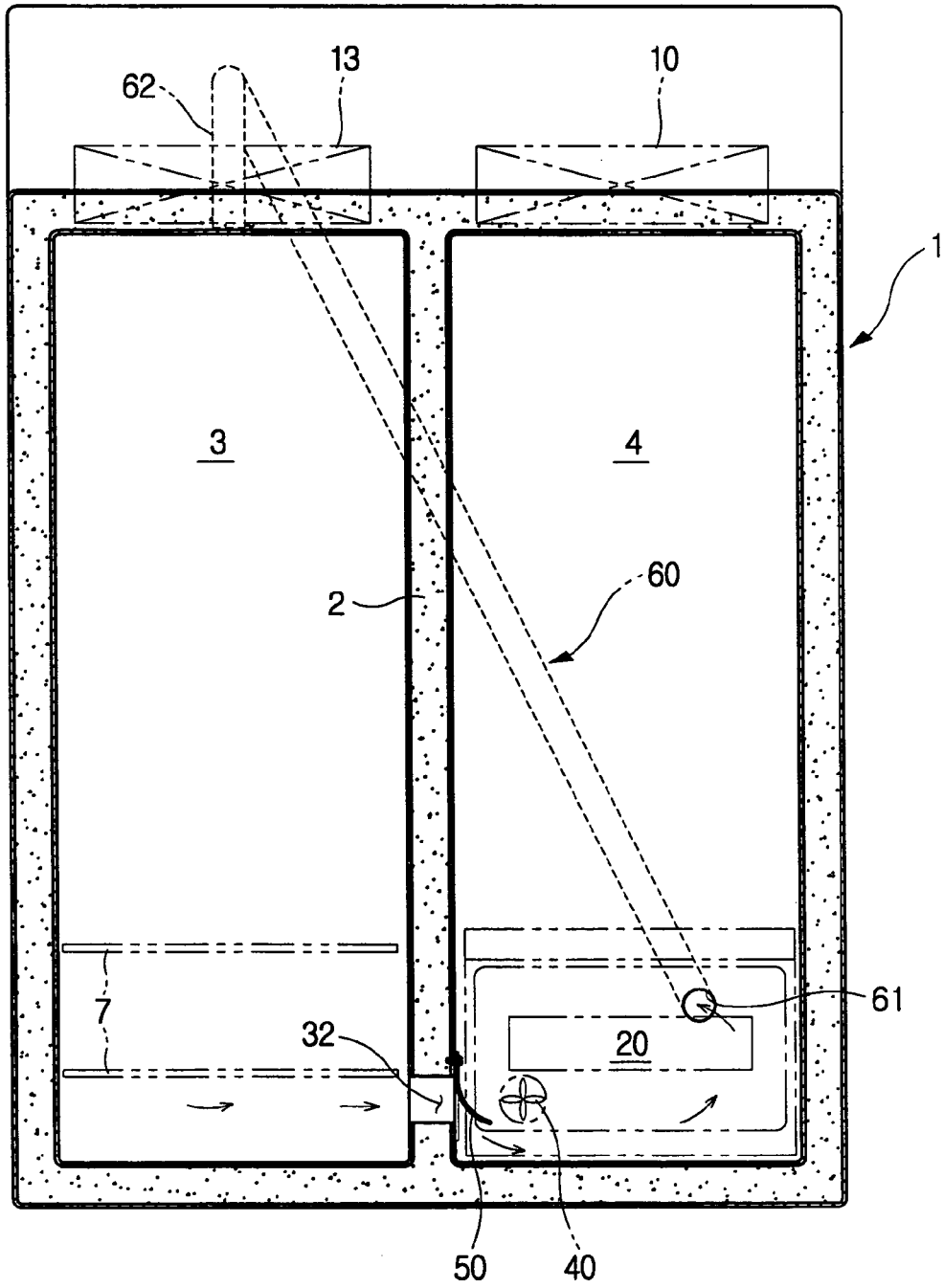
FIG. 5 is a schematic sectional view illustrating flow of cool air, according to an embodiment of the present invention, in which the cool air fed from a freezer compartment is circulated in the temperature-controlled chamber and then guided from the temperature-controlled chamber through a cool air discharging duct to a freezer compartment evaporator.
Figure 6:
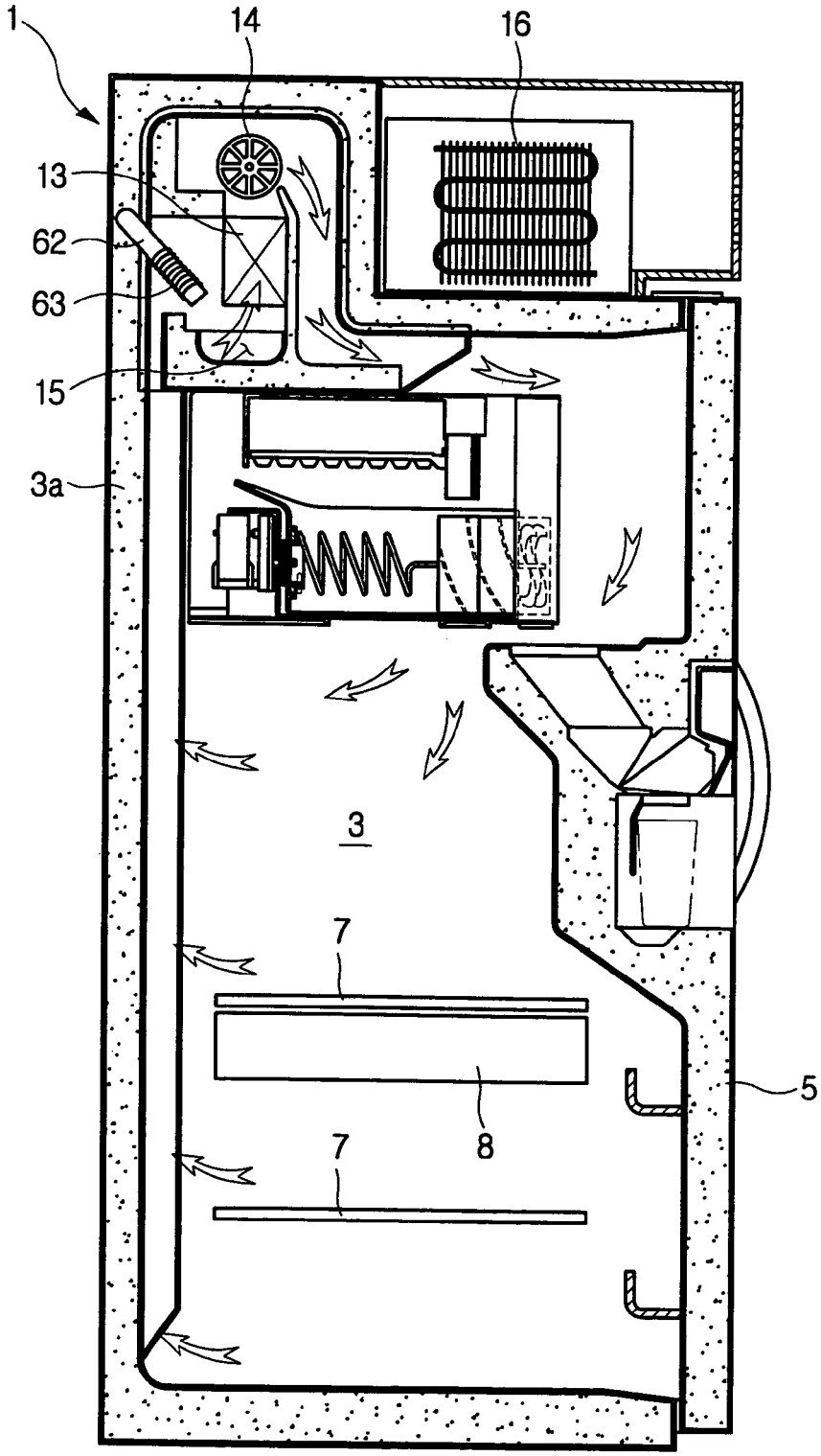
FIG. 6 is a schematic sectional view illustrating an arrangement of an outlet of the cool air discharging duct to discharge the cool air from the temperature-controlled chamber to an inlet of the freezer compartment evaporator.

FIGS. 5 and 6 illustrate the circulation of the cool air, in which the cool air is fed from the freezer compartment into the temperature-controlled chamber partitioned from the refrigerator compartment and then is fed back into the freezer compartment. FIG. 5 is a schematic sectional view illustrating flow of cool air, in which the cool air fed from the freezer compartment is circulated in the temperature-controlled chamber and then is guided from the temperature-controlled chamber through a cool air discharging duct to a freezer compartment evaporator. FIG. 6 is a schematic sectional view illustrating an arrangement of an outlet of the cool air discharging duct to discharge the cool air from the temperature-controlled chamber to an inlet of the freezer compartment evaporator.

As illustrated in FIG. 5, a cool air inlet port 32 is in the vertical partition wall 2 which partitions the cabinet 1 into the freezer compartment 3 and the refrigerator compartment 4, thus allowing the introduction of the cool air from the freezer compartment 3 into the temperature-controlled chamber 20 which is provided in the refrigerator compartment 4. The intake damper 50 is mounted to the vertical partition wall 2 at a side around the temperature-controlled chamber 20 to open or close the cool air inlet port 32.

Since the intake damper 50 comprises a flexible thin plate and is fixed at an upper end thereof to the vertical partition wall 2, the intake damper 50 is freely moved at a lower end thereof by flow of the cool air, thus opening or closing the cool air inlet port 32.

Thus, in the case where the cooling fan 40 is not running, the cool air inlet port 32 is closed by the intake damper 50. When cool air flows into the temperature-controlled chamber 20 by an operation of the cooling fan 40, the lower end of the intake damper 50 is upwardly moved, thus opening the cool air inlet port 32. Meanwhile, when flow of the cool air is stopped by a stoppage of the cooling fan 40, the lower end of the intake damper 50 is returned to an original position thereof, due to gravity of the flexible intake damper 50, in such a way as to be in close contact with the cool air inlet port 32, thus closing the cool air inlet port 32.

That is, the intake damper 50 opens or closes the cool air inlet port 32 by flow of the cool air without an additional drive device, so there is no power loss, in addition to preventing a generation of noise.

A cool air discharging duct 60 is provided along a rear wall 4*a* of the refrigerator compartment 4 and a rear wall 3*a* of the freezer compartment 3, so that the cool air is fed from the freezer compartment 3 through the cool air inlet port 32 into the temperature-controlled chamber 20 and returned from the temperature-controlled chamber 20 to the freezer compartment 3.

An inlet 61 of the cool air discharging duct 60 is connected to the cool air discharging passage 31 (see, FIG. 4) which is provided between the rear insulation wall 23 of the temperature-controlled chamber 20 and the rear wall 4*a* of the refrigerator compartment 4. An outlet 62 of the cool air discharging duct 60 is placed at a position adjacent to a freezer compartment evaporator 13 which is provided at a rear portion in an upper portion of the freezer compartment 3. That is, the cool air discharging duct 60 is provided along the rear wall 4*a* of the refrigerator compartment 4 and the rear wall 3*a* of the freezer compartment 3 in such a way as to upwardly extend from a rear portion of the temperature-controlled chamber 20 to the freezer compartment evaporator 13 which is provided at the upper portion of the freezer compartment 3.

As illustrated in FIG. 6, the freezer compartment evaporator 13 and a freezer compartment blowing fan 14 are provided at the rear portion in the upper portion of the freezer compartment 3. A condenser 16 is provided in front of the freezer compartment blowing fan 14.

The outlet 62 of the cool air discharging duct 60 passes through the rear wall 3*a* of the freezer compartment 3, and is downwardly inclined toward the freezer compartment evaporator 13 in such a way that an end of the outlet 62 is placed at a position adjacent to the inlet of the freezer compartment evaporator 13.

Further, a heater 63 comprising a heating coil is mounted to the outlet 62 of the cool air discharging duct 60 around an outer surface of the outlet 62. The heater 63 functions to remove frost which is formed on the outlet 62 due to a temperature difference between the cool air fed from the temperature-controlled chamber 20 to the outlet 62 of the cool air discharging duct 60 and the cool air fed from the freezer compartment 3 to the inlet of the freezer compartment evaporator 13. Water melted from the frost by an operation of the heater 63 flows along the outer surface of the outlet 62, which is downwardly inclined, and is collected in a drain pan 15 which is provided below the freezer compartment evaporator 13. The water collected in the drain pan 15 is discharged to the outside through a drain hose (not shown).

The process of cooling the interior of the temperature-controlled chamber 20 constructed in this way will be described as follows. The cool air inlet port 32 illustrated in FIG. 4 is closed by the intake damper 50, as illustrated in FIG. 3. In such a state, when the cooling fan 40 provided at the temperature-controlled chamber 20 is operated, cool air flows into the temperature-controlled chamber 20. At this time, the intake damper 50 is upwardly moved at the lower end thereof to open the cool air inlet port 32, as illustrated in FIG. 4.

Thus, as illustrated in FIG. 5, the cool air is fed from the freezer compartment 3 through the cool air inlet port 32 into the cool air intake passage 30, illustrated in FIG. 4, to be circulated in the temperature-controlled chamber 20. Subsequently, the cool air is fed into the cool air discharging passage 31 and into the inlet 61 of the cool air discharging duct 60.

The cool air entering the inlet 61 of the cool air discharging duct 60 upwardly flows along the cool air discharging duct 60, and is fed into the outlet 62 of the cool air discharging duct 60. Thereafter, the cool air downwardly flows from the outlet 62, thus being led to the inlet of the freezer compartment evaporator 13, as illustrated in FIG. 6.

Thus, the cool air circulated in the temperature-controlled chamber 20 is mixed, at the inlet of the freezer compartment evaporator 13, with the cooler air circulated in the freezer compartment 3. The mixed cool air passes through the freezer compartment evaporator 13, thus being cooled again.

When the cool air fed from the freezer compartment 3 is circulated in the temperature-controlled chamber 20 for a predetermined period of time, the temperature sensor 70 senses whether the temperature-controlled chamber 20 reaches a preset temperature or not. Thus, when the temperature sensor 70, illustrated in FIG. 4, senses that the temperature-controlled chamber 20 reaches a preset temperature, the cooling fan 40 is stopped. At this time, the flow of the cool air is stopped, so the intake damper 50 closes the cool air inlet port 32.

Through such a process, the interior of the temperature-controlled chamber 20 is controlled to be maintained at a predetermined temperature between a temperature of the freezer compartment 3 and a temperature of the refrigerator compartment 4.

Further, when frost is formed on the outlet 62 of the cool air discharging duct 60, the heater 63 is operated to remove the frost from the outlet 62. At this time, water melted from the frost is collected in the drain pan 15 which is provided below the freezer compartment evaporator 13.

Thus, by controlling an operation of the cooling fan 40, meat or fish is freshly stored at an example predetermined temperature between −3° C. to −5° C., thus allowing the meat or fish to be readily cooked without the necessity of being extensively thawed. Of course, it is possible to store other food items, at a predetermined temperature in addition to the meat or fish, in the temperature-controlled chamber 20.

According to an example embodiment of the present invention, only the intake damper is mounted in the cool air inlet port, so that the cool air flowing into the temperature-controlled chamber is controlled by only the intake damper. However, a discharging damper may be mounted at the inlet of the cool air discharging duct so as to control the flow of the cool air in cooperation with the intake damper, without being limited to the embodiment of the present invention. As is apparent from the above description, an embodiment of the present invention provides a refrigerator having a temperature-controlled chamber which is designed to be maintained at a predetermined temperature between a temperature of a freezer compartment and a temperature of a refrigerator compartment, thus maintaining the freshness of food items, such as meat and fish, without freezing the food items and thereby allowing the food items to be immediately cooked without thawing the food items, therefore allowing the food items to be rapidly cooked.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a refrigerator compartment and a freezer compartment partitioned from each other;

a temperature-controlled chamber provided in the refrigerator compartment so as to be partitioned from the refrigerator compartment;

a cool air inlet port to introduce cool air from the freezer compartment into the temperature-controlled chamber;

a cool air discharging duct to discharge the cool air from the temperature-controlled chamber into the freezer compartment; and a freezer compartment evaporator mounted at a portion of the freezer compartment, wherein the cool air discharging duct comprises:

an inlet connected to a cool air discharging passage provided at the temperature-controlled chamber to guide the cool air from the temperature-controlled chamber to the cool air discharging duct, and an outlet of the cool air discharging duct arranged at a position adjacent to an inlet of the freezer compartment evaporator to introduce the cool air from the cool air discharging duct into the freezer compartment evaporator.

2. The refrigerator according to claim 1, wherein the outlet of the cool air discharging duct is downwardly inclined toward the inlet of the freezer compartment evaporator.

3. The refrigerator according to claim 2, further comprising a heater mounted to the outlet of the cool air discharging duct which is downwardly inclined to defrost the outlet.

4. The refrigerator according to claim 1, further comprising an intake damper installed in the cool air inlet port so as to open or close the cool air inlet port.

5. The refrigerator according to claim 4, further comprising a cooling fan mounted at a portion of the temperature-controlled chamber so as to be positioned adjacent to the cool air inlet port to forcibly circulate the cool air from the freezer compartment through the temperature-controlled chamber and the cool air discharging duct to the freezer compartment evaporator.

6. The refrigerator according to claim 5, wherein the intake damper comprises a thin plate, thus opening the air inlet port in response to the cool air flowing into the temperature-controlled chamber when the cooling fan is operated, and closing the cool air inlet port in response to a stoppage of flow of the cool air when the cooling fan is stopped.

7. The refrigerator according to claim 5, further comprising a temperature sensor mounted in the temperature-controlled chamber, to control an operation of the cooling fan, thus allowing an interior of the temperature-controlled chamber to be maintained at a preset temperature.

8. The refrigerator according to claim 4, further comprising a discharging damper mounted at the inlet of the cool air discharging duct so as to control flow of cool air in cooperation with the intake damper.

9. The refrigerator according to claim 1, wherein the temperature-controlled chamber comprises a rear insulation wall, upper and lower insulation walls, and side insulation walls, and is opened at a front thereof, with a drawer to store items being put into the temperature-controlled chamber through the open front of the temperature-controlled chamber.

10. The refrigerator according to claim 1, wherein the cool air inlet port has only an intake damper installed so as to open or close the cool air inlet port.

11. The refrigerator according to claim 10, further comprising a discharging damper mounted at the inlet of the cool air discharging duct so as to control flow of cool air in cooperation with the intake damper.

12. A method of cooling a compartment in a refrigerator, comprising:

sensing a temperature of the compartment;

operating a fan when the temperature sensed is above a predetermined temperature;

circulating forcibly cool air from a freezer in the refrigerator when the fan operates;

opening an air inlet port that opens to the compartment with the circulating cool air;

cooling the compartment with the circulating cool air;

discharging the air from the compartment that was cooled into a duct;

guiding the discharged air into an evaporator of the freezer; and mixing the discharged air with the cool air in the freezer.

13. The method of cooling a compartment in a refrigerator according to claim 12, further comprising:

closing the air inlet port that opens to the compartment when the temperature sensed is below the predetermined temperature.

14. The method of cooling a compartment in a refrigerator according to claim 12, further comprising:

heating at least part of the air guided to the compartment flowing to the freezer, to remove frost; and collecting water from the heating of the frost.

15. A refrigerator, comprising:

a first compartment and a second compartment;

a temperature-controlled chamber provided in the first compartment;

an inlet port to introduce a gas from the second compartment into the temperature-controlled chamber; and a discharging duct to discharge the gas from the temperature-controlled chamber into the second compartment, wherein an inlet of the discharging duct is connected to a discharging passage provided at the temperature-controlled chamber to guide the gas from the temperature-controlled chamber through the inlet of the discharging duct to the discharging duct, and an outlet of the discharging duct is arranged at a position adjacent to an inlet of a second compartment evaporator to introduce the gas from the discharging duct into the second compartment evaporator, the second compartment evaporator being mounted at a portion of the second compartment.

16. The refrigerator according to claim 15, wherein the outlet of the discharging duct is downwardly inclined toward the inlet of the second compartment evaporator.

17. The refrigerator according to claim 16, further comprising an intake damper installed in the inlet port at a side around the temperature-controlled chamber so as to open or close the inlet port.

18. The refrigerator according to claim 17, wherein the intake damper comprises a plate to open the inlet port when the fan is operated, and close the air inlet port when the fan is stopped.

19. The refrigerator according to claim 16, further comprising a fan mounted at a portion of the temperature-controlled chamber so as to be positioned adjacent to the air inlet port, thus forcibly circulating the gas from the second compartment through the temperature-controlled chamber and the discharging duct to the second compartment evaporator.

20. The refrigerator according to claim 19, further comprising a temperature sensor mounted in the temperature-controlled chamber, to control an operation of the fan.

21. The refrigerator according to claim 15, further comprising a heater mounted to the outlet of the discharging duct which is downwardly inclined.

* * * * *